United States Patent [19]

Stiasny

[11] Patent Number: 4,872,232

[45] Date of Patent: Oct. 10, 1989

[54] PORTABLE GOLF CLUB HEAD CLEANER

[75] Inventor: Janos G. Stiasny, Vancouver, Canada

[73] Assignee: Club Mate Products Inc., Vancouver, Canada

[21] Appl. No.: 257,934

[22] Filed: Oct. 14, 1988

[51] Int. Cl.[4] ..... A63B 57/00; A46B 13/08

[52] U.S. Cl. ..... 15/21 E; 15/21 R

[58] Field of Search ..... 15/21 R, 21 A, 21 C, 15/21 D, 21 E, 39, 97 R, 104.92; 134/6

[56] References Cited

U.S. PATENT DOCUMENTS

| | | | |
|---|---|---|---|
| 3,332,099 | 7/1967 | Reiter | 15/21 R |
| 3,619,841 | 11/1971 | Russell et al. | 15/21 |
| 3,872,534 | 3/1975 | Hoag | 15/21 |
| 4,464,072 | 8/1984 | Norwell | 15/21 A |
| 4,472,851 | 9/1984 | Kinsey | 15/21 |
| 4,734,952 | 4/1988 | Parchment et al. | 15/104.92 |

*Primary Examiner*—Edward L. Roberts

*Attorney, Agent, or Firm*—Bull, Housser & Tupper

[57] ABSTRACT

Portable golf club head cleaner includes a body having a location for receiving a golf club head and a reservoir for holding a liquid. A brush for cleaning the golf club head includes means for moveably mounting the brush within the body, adjacent the location. Pumping means pump liquid from the reservoir onto the brush on operation of manually operable means which simultaneously pumps the pumping means and moves the brush to clean a golf club head at the location. The brush may move in a reciprocal manner or may be cylindrical in shape and move by rotation about its axis. The pumping means can include a piston within the reservoir moveable between an upper and lower position and a shaft having an internal tube connecting the piston to the manually operable means. The manually operable means moves in a reciprocal manner to reciprocate the shaft and piston forcing liquid from the reservoir into the tube on downward stroke of the piston. The liquid travels up the tube and is expressed onto the brush. The brush may be attached to the shaft for reciprocal movement therewith.

16 Claims, 4 Drawing Sheets

PORTABLE GOLF CLUB HEAD CLEANER

BACKGROUND OF THE INVENTION

1. Field of the Invention

The present invention generally relates to a portable golf club head cleaner and, more particularly, is concerned with a manual operated cleaner which contacts the club head with a moving brush and simultaneously sprays liquid on the club head.

2. Description of the Prior Art

In recent years there has been a substantial increase in participation in leisure sporting activities, including the game of golf. Golf has proved to be a popular past time with an ever increasing number of participants taking up the game. It often occurs that in playing the game, the golf club head will become embedded with dirt, sand and other foreign materials. These materials can clog up the grooves cut into the face of the golf club head and can prevent proper contact between the club head and the golf ball. Furthermore, as the golf club head is generally precision balanced for optimum hitting force, these foreign materials are an impediment to improved play of the game.

Often participants carry along a cloth or the like to wipe the club head clean after it becomes clogged with foreign materials. As well, at times a golf tee is used to scrape out foreign material stuck in the grooves of the face of the golf club head. These cleaning methods are not usually satisfactory in cleaning the club head. The cloth soon becomes soiled from repeated use and cannot then be used. The hands of the participant also may become dirty through these cleaning methods. Furthermore, none of these cleaning methods provide a water source to assist in the cleaning process.

In the past, devices have been constructed for cleaning golf club heads. For example, U.S. Pat. No. 4,734,952 by Parchment et al discloses a golf club head cleaner which includes a tub for holding a cleaning solution with a plurality of brushes inside the tub. The club head is placed in the tub and moved upwardly and downwardly by the user to clean the club head. The Parchment device requires up and down movement of the golf club to clean it. This movement can damage the club if too much pressure is placed on it in moving it up and down. As well, liquid in the container will be lost with vigorous up and down motion. As well, there is no spray action of pumped water on the club head.

Another example of previous devices used to clean a golf club head is U.S. Pat. No. 4,472,851 by Kinsey. A rotating brush is provided to clean the club head and, simultaneously cleaning fluid is applied to the golf club head. The device must be attached to a source of pressurized water to rotate the brush. Consequently, this device is not readily used on a golf course when the club head is most likely to become soiled as this device is not portable. Furthermore, it is difficult to control the speed of the brush rotation and such a cleaner can be dangerous to operate and may spray dirty cleaning fluid and/or water on the user.

SUMMARY OF THE INVENTION

The present invention provides an apparatus for cleaning a golf club head which is self contained and which is portable. A reservoir holds the cleaning liquid which is forced onto the golf club head by a manual pump operated by the user. The pump action also causes a brush to move against the club head to assist in the cleaning action.

Accordingly, the present invention relates to a portable golf club head cleaner having a body with a location for receiving a golf club head and a reservoir for holding a liquid. The cleaner also includes a brush for cleaning a golf club head when adjacent the brush. Means for moveably mounting the brush within the body, adjacent said location and pumping means for pumping liquid from the reservoir onto the brush are also included. Also provided is a manually operable means for simultaneously pumping the pumping means to pump liquid onto the brush and for moving the brush to clean a golf club head at said location.

The brush may move in a reciprocal manner or the brush may be cylindrical and move by rotating about its axis.

Optionally, the pumping means may include a piston within the reservoir moveable between an upper position adjacent the top of the reservoir and a lower position adjacent the bottom of the reservoir, whereby liquid in the reservoir is forced upwardly past the piston upon downward movement of the piston. A shaft with first and second ends is connected to the piston at the first end and to the manual operable means at the second end. The shaft has an internal congitudinal tube open to the reservoir at the first end and extending laterally adjacent the brush at the second end. The tube receives and directs the liquid forced up from the reservoir onto the brush. The manually operable means works the pumping means in a reciprocal manner.

The brush may be attached to the shaft for reciprocal movement therewith. The manually operable means may reciprocate between an extended position and retracted position with biasing means for biasing the manually operable means in the extended position. The end of the tube adjacent the brush may include a spray means for spraying liquid onto the brush. The shaft may include means for preventing liquid in the tube from draining into the reservoir. The brush may be cylindrical and the apparatus may include rotating means for rotating the brush upon reciprocal movement thereof.

DESCRIPTION OF THE PREFERRED EMBODIMENT

Figure 1:
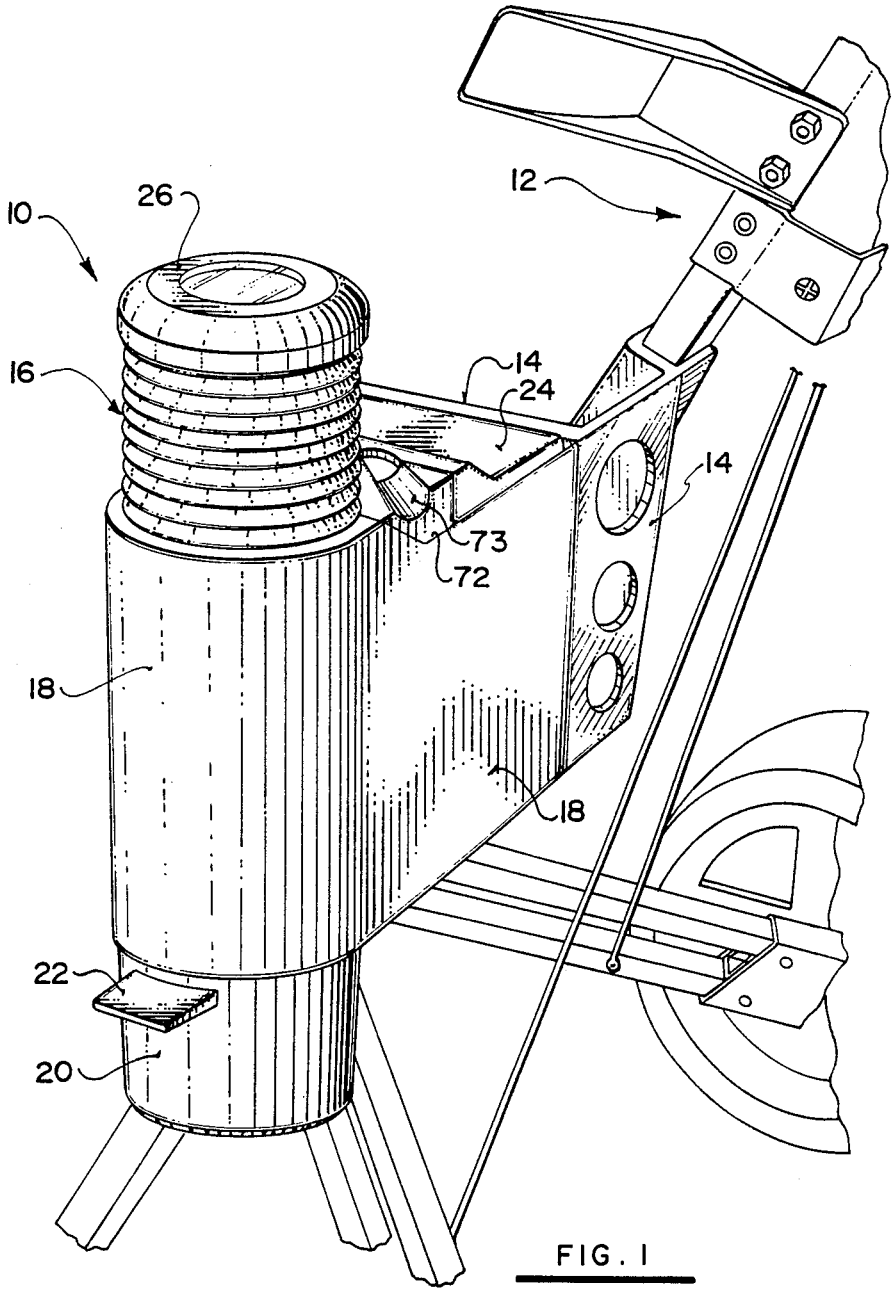
FIG. 1 is a perspective view of a portable golf club head cleaner according to an embodiment of the present invention.

Referring to the drawings, and in particular FIG. 1 there is shown a portable cleaning apparatus, generally designated 10, for cleaning a golf club head. Apparatus 10 is shown attached to golf pull cart 12 by means of bracket 14. Apparatus 10 travels with cart 12 for portable cleaning of a golf club head. However it should be understood that apparatus 10 may be mounted to an electric golf cart or other portable apparatus. As well, apparatus 10 may be permanently affixed, for example, at the beginning of each hole in a golf course similar to the positioning of golf ball cleaners or at a driving range or pro shop. Mounting apparatus 10 to a portable device, like a pull cart or electric cart, is particularly advantageous as apparatus 10 travels with the golfer ready for use immediately after the club head becomes soiled. This permits the golfer to clean the club head before the dirt and other foreign matter have dried and also permits the virtual immediate re-use of the same club after cleaning.

Apparatus 10 includes actuating means 16, housing 18 and reservoir 20. Reservoir 20 includes lateral flange 22 for pre-cleaning dirt and other foreign material from the club head. Lid 24 covers the cleaning area (not shown) and the club head when in position for cleaning. Lid 24 prevents liquid and dirt from spraying the operator when apparatus 10 is in use. Lid 24 is hinged at hinge 25 (seen in FIG. 3) to open to permit a golf club head to be placed into housing 18 for cleaning. This open position of Lid 24 is best seen in FIG. 2.

Figure 2:
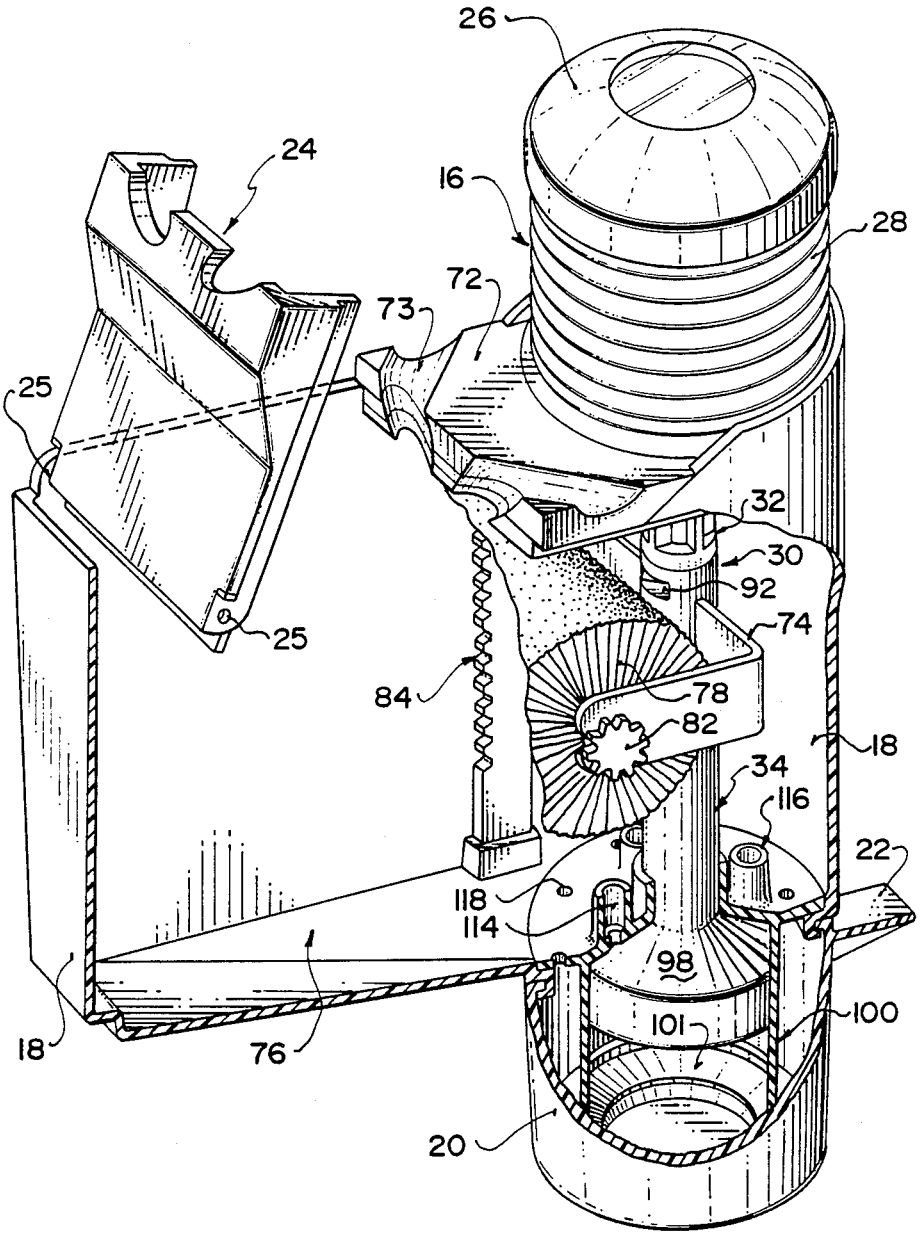
FIG. 2 is a perspective view, with parts broken away, of the cleaner.
Figure 3:
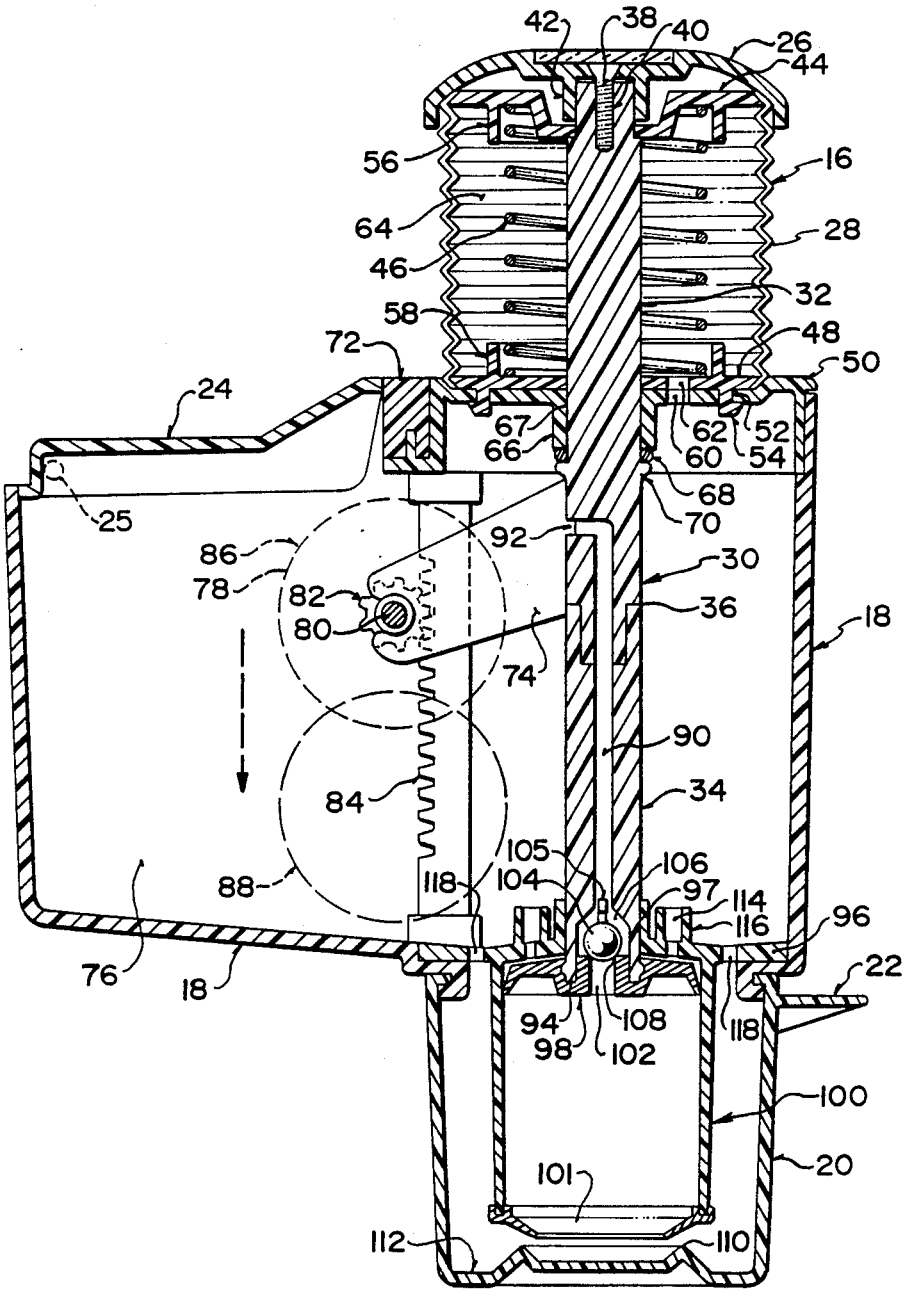
FIG. 3 is a side section view of the cleaner.
Figure 4:
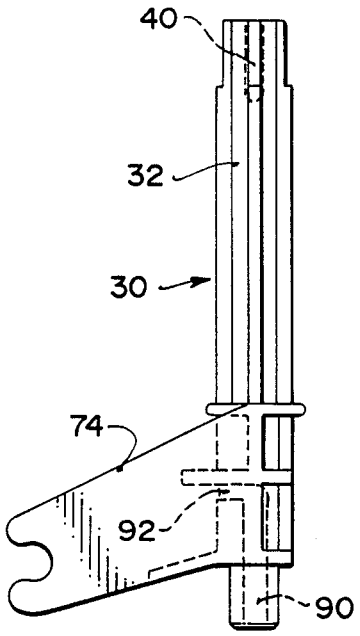
FIG. 4 is a side view of the shaft and yolk assembly of the cleaner.
Figure 5:
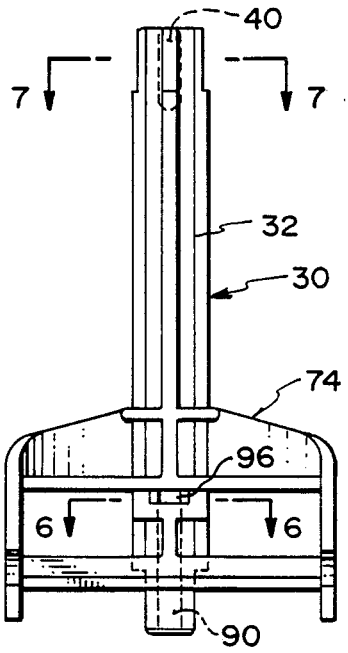
FIG. 5 is a front view of the shaft and yolk assembly of the cleaner.
Figure 6:
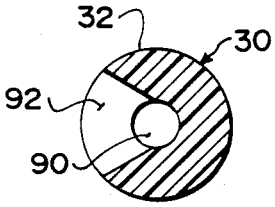
FIG. 6 is a cross section view along line 6—6 of FIG. 5, of the spray nozzle of the cleaner.
Figure 7:
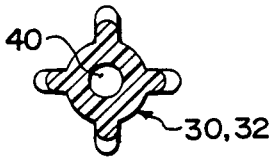
FIG. 7 is a cross section view, along line 7—7 of FIG. 5, of the shaft within the housing conduit of the cleaner.

Referring to FIGS. 2 and 3, pumping action is actuated by hand pressure downward on platform 26. Bellows 28 permit reciprocating motion of platform 26 which is attached to shaft 30. Shaft 30 moves with platform 26 in a reciprocating manner.

As seen in FIG. 3, shaft 30 is made up of two sections, upper section 32 and lower section 34, joined end to end at 36. Section 32 is joined to the underside of platform 26 by male extension 38 extending downwardly from platform 26 which engages corresponding female slot 40 in the upper end of section 32. Underside of platform 26 also includes a circular downwardly-extending boss 42 to receive and secure the top of section 32 therein. Upper resilient gasket 44 is positioned below platform 26 and engages downwardly extending periphery of platform 26. Gasket 44 includes a hole in the centre to slidably receive section 32 therethrough.

Lower end of bellows 28 is secured to lower gasket 48. Housing 18 includes an upper cover 50 secured to the portion of the top of housing 18 above reservoir 20. Bearing plate 50 includes openings 52 which accept hooks 54 extending downwardly from the underside of lower gasket 48. Hooks 54 securely hold actuating means 16 to plate 50.

Spring 46 is positioned between upper gasket 44 and lower gasket 48. The lower face of upper gasket includes a circular boss 56 of suitable diameter to accept the top of spring 46 therein. Similarly, the upper face of lower gasket 48 includes an upwardly extending boss 58 of suitable diameter to accept the lower end of spring 46 therein. Spring 46 provides biasing means to return platform 26 to its extended position (as shown in FIG. 2 and FIG. 3) when downward pressure on platform 26 is released.

Bearing plate 50 includes opening 60 which is aligned with opening 62 of gasket 48. These openings permit air within cavity 64 of bellows 28 to exhaust into housing 18 when platform 26 is depressed by the user and permits air to re-enter cavity 64 when platform 26 is raised by spring 46 to its extended position.

Boss 66 extends downwardly from a centered hole in cover 50 to accept and support section 32 of shaft 30. "O"—ring 68 extends around section 32 just below lower end of boss 66 to act as a dampener between boss 66 and section 32 when the section is raised by spring 46. This reduces noise and shock on shaft 30 by preventing section 32 from striking bearing plate 50 as "O—ring" 68 absorbs this shock when platform 26 arrives at the extending position. "O"—ring 68 is held in place by tight fit onto section 32 and cannot move down past shoulder 70.

Club holder 72 is attached to plate 50 between lid 24 and plate 50. Club holder 72 includes two grooved section 73 (seen best in FIG. 1) to support the golf club and properly align the golf club head in apparatus 10.

Upper section 34 of shaft 30 includes a pair of parallel arms, forming yoke, 74 extending towards the centre of housing 18. Cylindrical brush assembly 78 has a threaded stainless steel shaft 80 which is rotatably connected to the end of each arm of yoke 74 permitting brush 78 to rotate about shaft 80 while attached to yoke 74.

Each end of shaft 80 of brush 78 includes a co-axial pinion gear 82 each of which gears mesh with a corresponding toothed rack 84. Upon reciprocal motion of shaft 30 pinion gear 82 reciprocates along rack 84 thereby rotating brush 78. Upper position 86 and lower position 88 of brush 78 as it reciprocates is shown in FIG. 3.

Cavity 76 is for housing the gold club head therein against brush 78 to clean the golf club head by light friction of the reciprocating and rotating brush 78 thereon. Housing 18 which surrounds cavity 76, together with lid 24, keep any dirt brushed off the club head from spraying the user.

Lower section 34 of shaft 30 is rigidly attached to upper section 32 by any suitable method; in this case by means of ultrasonic welding. Opening 90 extends longitudinally within shaft 30 from the bottom of lower section 34 to part way into upper section 32. Opening 90 bends at a 90° angle in upper section 32 to open to cavity 76 from the side of shaft 30 adjacent the ends of brush 78. Nozzle 92 covers the end of opening 90 to cause a spray action of liquid travelling up opening 90 to spray the brush into cavity 76 with liquid. This assists the cleaning action of brush 78.

Bottom plate cylinder 96 is attached to the lower part of housing 18 below actuating means 16. Cylinder 96 provides an opening 97 in the centre to accept lower section 34 of shaft 30 slidably therein. The lower end 94 of lower section 34 is attached to piston 98 below cylinder 96. Piston 98 is circular and just fits within cylindrical cup 100 extending co-axially from cylinder 96 to form a liquid-tight seal about the periphery of the piston. Piston 98 reciprocates within cup 100 between an upper position adjacent to top of cup 100 (shown in FIG. 3) and a lower position adjacent the bottom of cup 100 (not shown). Piston 98 has a central opening 102 which joins opening 90 of shaft 30. Ball 104 is situated within opening 90 and is adjacent lower end 94 of section 34. Ball cavity 106 is large enough to permit liquid to flow past ball 104 when forced up into opening 102 from within cup 100. When platform 26 is pressed and downward motion of the shaft is initiated then ball 104 will be forced to move upward thereby allowing liquid to move into opening 90, by means of piston 98 inducing pressure within the cup 100. While the water is forced upward through the cavity 106, ball 104 will be stationed at the upper end of the cavity 106 which has 3 x 120° displaced ribs 105 to stop ball 106 from rising further and at the same time allow liquid to flow through. Ball 104 sits in seat 108 when no liquid is forced up into opening 102 and forms a liquid-tight seal to prevent liquid from flowing down opening 90 past ball 104.

Membrane 101 extends around the circumference of the bottom end of cup 100 and is pivotable between an open position (shown in FIG. 3) permitting liquid to flow between reservoir 20 and cup 100 and a closed position, caused by pressure on membrane 101 from within cup 100, whereby no liquid may flow between reservoir 20 and cup 100. Pressure on membrane 101 from within cup 100 is caused by downward movement of piston 98 within cup 100 and forces the outer edge of membrane 101 tight against protruberance 110 about the central axis of the bottom of reservoir 20. Protruberance 110 also forms an outer depression 112 about the periphery of protruberance 110 to collect any dirt and other foreign material in the liquid within reservoir 20.

Cylinder 96 contains a plurality of inner openings 114 connecting cavity 76 with the area above piston 98 within cup 100. Boss 116 extends upwardly from opening 114 to prevent dirt and other foreign material from entering opening 114. A plurality of outer openings 118 connect cavity 76 with the interior of reservoir 20 to the outside of cup 100. As opening 118 does not have a vertical boss any dirt or other foreign material in cavity 76 will tend to drain with liquid in cavity 76 to the bottom of reservoir 20 and settle into depression 112. This dirt and foreign material may then be easily removed by removing reservoir 20 and rinsing it out. Reservoir 20 is attached to housing 18 by means of a bayonette mount and is readily detached from housing 18 to facilitate the cleaning process.

It can be seen that any liquid sprayed within cavity 76 will drain to the bottom of cavity 76 and flow mainly through opening 118. Dirt and foreign material will also tend to flow through opening 118 and not opening 114 because of boss 116. Opening 114 will also permit air to enter above piston 98 on downward movement of the piston and permit air to escape this area on upward movement of piston 98.

Operation

The operation of the embodiment described above will now be described with reference primarily to FIG. 3.

Apparatus 10 may be mounted to a push cart using bracket 14. Apparatus 10 is mounted with actuating means 16 at the top and reservoir 20 at the bottom. To prepare apparatus 10 for use, reservoir 20 is twisted thereby releasing the reservoir from housing 18. Reservoir 20 is filled with liquid, such as soapy water, and the reservoir is re-attached to housing 18 by means of the bayonette mount. Alternatively the soapy water may be added by opening lid 24 and pouring the soapy water into housing 18. The soapy water will drain into reservoir 20 through opening 118. Apparatus 10 then travels with the pull cart ready for immediate use to clean a golf club head.

When the golfer wishes to clean a soiled golf club head he or she inserts the club head, facing down, into cavity 76 and the shaft of the golf club is positioned into one groove 74 (seen in FIG. 1). A similar groove is formed at the opposite side of the apparatus to position a left-hand club. The club face should be facing brush 78 when in cavity 76. The golfer then closes lid 24 and holds the golf club so that the face of the golf club head is against brush 78 with one hand and pushes down on platform 26 with the other hand. Platform 26 is thereby pushed downwardly against spring 46 and bellows 28 are pushed together. Air in bellows cavity 64 escapes through opening 62 and 60 into cavity 76. Shaft 30 is forced downward through opening 67 in bearing plate 50 and through opening 97 in bottom plate cylinder 96. Piston 98 is forced downwardly in cup 100 and membrane 101 closes to prevent liquid from travelling to the outer part of reservoir 20. Liquid is forced by the pressure caused by piston 98 up into opening 102 forcing ball 104 up and permitting liquid to flow into ball cavity 106 and into opening 90. This pressure causes the liquid to flow up opening 90 and through nozzle 92 to spray liquid into brush 78 and onto the golf club face. Liquid dripping from the club face and brush is collected in cavity 76 and flows under gravity through opening 118 into reservoir 20. Dirt and other foreign matter in cavity 76 is carried with the liquid through opening 118 into reservoir 20 and settles to the bottom in depression 112. Opening 114 permits air and liquid to flow into and out of the area above piston 98 within cup 100 as piston 98 is moved up and down in cup 100.

Downward movement of shaft 30 causes brush 78 to be moved downward across the club face. As brush 78 moves down rack and pinion gearing cause brush 78 to rotate about shaft 80 which causes added friction of brush 78 against the club face to facilitate the cleaning process.

The user then releases downward pressure on platform 26 and spring 46 forces platform to the extended position with bellows 28 extended. O-ring 68 acts to dampen the spring action providing a more gradual return to the extended position.

The above pressure and release steps are repeated by the user in rapid succession to cause rapid reciprocal action of the brushes on the club face with liquid pumped onto brush 78 from within cup 100 on each downward stroke on platform 26. This is continued until the club head has been suitably cleaned.

Ball 104 prevents liquid in opening 90 from returning under gravity to reservoir 20. A column of liquid remains in opening 90 after each down stroke to provide more efficient liquid spray be reducing spray of air at the start of each downward stroke. The lid is closed when the club is in cavity 76 to prevent spraying of water and dirt onto the user and to permit efficient recycling of liquid for re-use.

When the water in reservoir 20 is too dirty to efficiently clean a club face, or more periodically at the discretion of the user, reservoir 20 may be removed and the dirt and liquid therein may be rinsed out. Clean liquid can be placed in the reservoir if continued operation is desired. If desired, this cleaning process can be undertaken at the completion of 18 holes of golf.

Apparatus 10 may be removed from the push cart for separate storage or may be collapsed with the push cart and travel with it to be stored.

Various changes and modifications in the portable golf club head cleaner as herein described may occur to those skilled in the art, and to the extent that such changes or modifications are embraced by the appended claims, it is to be understood that they constitute a part of the present invention.

I claim:

1. A portable golf club head cleaner, comprising:

(a) a body having a location for receiving a golf club head and a reservoir for holding a liquid;

(b) a brush for cleaning a golf club head when adjacent the brush;

(c) means for moveably mounting the brush within the body, adjacent said location;

(d) pumping means for pumping liquid from the reservoir onto the brush; and (e) manually operable means for simultaneously pumping the pumping means to pump liquid onto the brush and for moving the brush to clean a golf club head at said location.

2. A cleaner as described in claim 1 wherein the brush moves in a reciprocal manner.

3. A cleaner as described in claim 1 wherein the brush is cylindrical in shape and moves by rotation about its axis.

4. A cleaner as described in claim 1 wherein the pumping means comprises:

(a) a piston within the reservoir moveable between an upper position adjacent the top of the reservoir and a lower position adjacent the bottom of the reservoir whereby liquid in the reservoir is forced upwardly past the piston upon downward movement of the piston;

(b) with a first end and a second end, connected to the piston at the first end and to the manual operable means at the second end, said shaft having an internal longitudinal tube open to the reservoir at the first end and extending laterally adjacent the second end to open adjacent the brush whereby liquid forced upwardly by the piston is directed by the tube onto the brush;

wherein said manually operable means moves the pumping means in a reciprocal manner.

5. A cleaner as described in claim 4, wherein the brush is connected to the shaft for reciprocal movement therewith.

6. A cleaner as described in claim 4, wherein the manually operable means reciprocates between an extended position and a retracted position further comprising:

(a) biasing means for biasing the manually operable means in the extended position.

7. A cleaner as described in claim 4 wherein the shaft further comprises means for preventing liquid in the tube from draining into the reservoir.

8. A cleaner as described in claim 7 wherein the means for preventing liquid in the tube from draining into the reservoir is a ball in the tube whereby the ball is forced up against a rib when liquid is forced up the tube permitting liquid to move past the ball to the end of the tube and wherein gravity seats the ball against a seat when liquid is not forced up the tube forming a liquid tight seal between the ball and seat preventing liquid in the tube from flowing from the tube to the reservoir.

9. A cleaner as described in claim 4 wherein the brush is cylindrical in shape further comprising:

(a) rotating means for rotating the brush upon reciprocal movement thereof.

10. A cleaner as described in claim 9 wherein the brush further comprises an axial shaft and wherein the rotating means comprises:

(a) a gear coaxial with the brush mounted on the shaft; and (b) a toothed rack meshing with the gear to cause rotation of the brush on reciprocal motion of the brush.

11. A cleaner as described in claim 4 wherein the reservoir comprises:

(a) a cup in the reservoir attached to the reservoir at the top end of the reservoir and open to the reservoir adjacent the bottom end of the reservoir for retaining the piston slidably therein and wherein a liquid-tight seal is formed between the periphery of the piston and the inner face of the cup;

(b) closing means for closing the bottom end of the cup on downward movement of the piston;

and wherein the tube opens to the interior of the cup below the piston.

12. A cleaner as described in claim 4 further comprising spraying means for spraying the liquid onto the golf club head, said spraying means connected to the other end of the tube.

13. A cleaner as described in claim 1 further comprising collecting means for collecting liquid after the liquid is pumped onto the brush and for returning the liquid to the reservoir.

14. A cleaner as described in claim 13 wherein the collecting means comprises a hole between the body and the reservoir to permit liquid in the body to drain from the body to the reservoir.

15. A cleaner as in claim 13 further comprising preventing means for preventing dirt dislodged from the club head face from entering the reservoir.

16. A cleaner as described in claim 15 wherein the preventing means comprises a boss extending into the body from the periphery of the opening.

* * * * *